United States Patent [19]

Minvielle et al.

[11] 4,411,555

[45] Oct. 25, 1983

[54] DRAINING, IRRIGATING AND DISPERSING MASS

[76] Inventors: Monique L. S. Minvielle, 11, rue Solférino, 75007 Paris; Albert H. F. Mazoin, 24570 Condat sur Vezere, Dordogne; Robert P. Brun, Avenue de la Croix du Sud, 33120 Arcachon; Sylvain V. L. Chevanne, 95450 Themericourt, Val d'Oise; Jacques L. A. Sée, 92200 Neuilly-sur-Seine, Hauts de Seine, all of France

[21] Appl. No.: 169,711

[22] Filed: Jun. 17, 1980

[30] Foreign Application Priority Data

| | | | |
|---|---|---|---|
| Jul. 17, 1979 | [FR] | France | 79 18429 |
| Dec. 11, 1979 | [FR] | France | 79 30298 |
| Jul. 3, 1980 | [FR] | France | 80 14849 |

[51] Int. Cl.[3] ..... E02B 11/00

[52] U.S. Cl. ..... 405/50; 405/36; 405/47

[58] Field of Search ..... 405/36–43, 405/50, 15, 33–35, 45–48, 29

[56] References Cited

U.S. PATENT DOCUMENTS

| | | | |
|---|---|---|---|
| 2,183,657 | 12/1939 | Page | 405/50 X |
| 2,639,909 | 5/1953 | Leva | 405/50 X |
| 3,167,600 | 1/1965 | Worman | 405/50 X |
| 3,233,414 | 2/1966 | Hansen et al. | 405/50 |
| 3,252,287 | 5/1966 | Suzuki | 405/33 X |
| 3,685,298 | 8/1972 | Takanashi | 405/36 |

FOREIGN PATENT DOCUMENTS

| | | | |
|---|---|---|---|
| 2817252 | 11/1978 | Fed. Rep. of Germany | 405/50 |
| 431309 | 7/1935 | United Kingdom | 405/36 |
| 850135 | 9/1960 | United Kingdom | 405/34 |

*Primary Examiner*—Dennis L. Taylor

*Attorney, Agent, or Firm*—Kirschstein, Kirschstein, Ottinger & Cobrin

[57] ABSTRACT

The mass for the drainage, irrigation and lightening of soils is constituted by hollow elements (1) delimiting capillar or semi-capillar passages. The elements (1) are bulked up so that they can rest in an irregular fashion one relative to the others by providing inbetween spaces of variable shapes and dimensions.

Drainage, irrigation, lightening, enrichment of soils.

3 Claims, 14 Drawing Figures

DRAINING, IRRIGATING AND DISPERSING MASS

The present invention relates to the drainage of soils by means of a porous mass which can also be used for irrigation purposes.

In fact, due to its construction, the mass of the invention allows maintaining the soil in which it is buried in a state of great permeability, and, since this mass may be placed according to any disposition, the drainage or irrigation and lightening functions may be carried out without difficulty. The mass of the invention exhibits the feature of being very difficult to clog up and therefore it can keep its properties for a very long time when dispersed in the soil.

A further advantage of the mass of the invention resides in the fact that its constituent elements allow making connections and deviations in all directions and eventually with other drainage devices when they are placed in a trench.

The draining mass of the invention remedies also the problem well known of the specialists who use perforated drainage tubes in the holes of which the roots make their way and tend to proliferate by forming what they call "foxtails".

Where, on the contrary, the mass of the invention is used for irrigation purposes, notably for cultivations on slabs, it forms a kind of soft underground litter which can be fed with water through ducts emerging from the slab. The compressibility of the mass is such that the water has a tendency to be distributed and to re-ascend by capillarity under the effect of the earth pressure. The mass causes also an air circulation, notably if ventilation holes are provided in the support slab, which is very favourable for the life of the crops.

On the other hand, when the constituent elements of the mass are dispersed within the earth on the occasion of a deep ploughing, they contribute to a lightening of the density of the ground by forming, after the manner of "tunnels" dug by earthworms, multiple ventilation, circulation and irrigation ducts which favour the crops and the distribution of the fertilizers.

In this respect, said elements may be advantageously charged with fertilizers when being dispersed in the ground, thereby becoming a progressive carrier for these products.

According to the invention, the mass for the drainage, respectively irrigation and lightening of various soils, is characterized in that it is formed by hollow elements delimiting capillary or semi-capillary passages, said hollow elements being bulked up so that they come to rest onto each other in an irregular fashion by providing in between spaces of various shapes and dimensions which combine with the capillary or semi-capillary passages which they present by forming a mass dispersed in the soil to be loosened and balanced.

Various other characteristics of the invention will become apparent from the following detailed description.

Embodiments of the objects of the invention are shown, by way of non limitative examples, in the accompanying drawings wherein:

FIG. 1 is a perspective view of a hollow element used for making the draining or irrigation mass of the invention, FIG. 2 is a schematic cross-sectional view illustrating a draining mass formed in trenches, FIGS. 3 to 5 are perspective views of other embodiments of the hollow elements used for forming the draining or irrigation mass of the invention, FIG. 6 is a perspective view of a drainage and irrigation element according to the invention, in an open condition.

Figure 1:
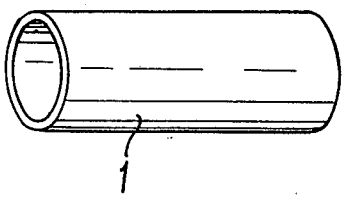

FIG. 1 shows a hollow element 1 the length of which can vary within relatively large proportions as to its diameter. However, a length/diameter ratio between 1 and 2, and 1 and 10, appears as particularly appropriate, the diameter being preferably between 2 and 20 mm. The wall thickness of the hollow body 1 may also vary rather widely so that some hollow elements may be more rigid than others.

Figure 2:
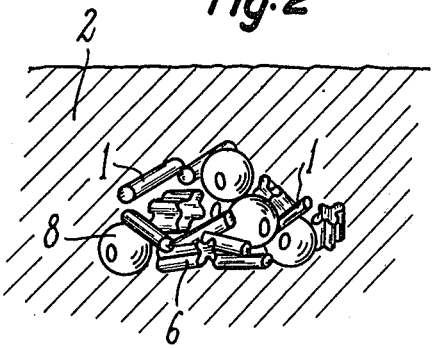

For forming a draining mass, one digs in the ground a trench 2, such as the trench shown in FIG. 2, and the hollow elements are bulked up in said trench. It is advantageous that said hollow elements exhibit different characteristics as regards their length and diameter so that they intermingle and get more or less deformed.

For forming the draining mass, it is further advantageous that the hollow elements are not all of the same shape, or that their shape is adapted as a function of the particular results to obtain.

Figure 3:
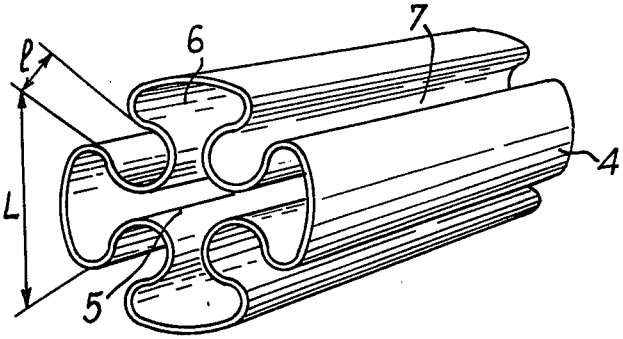

FIG. 3 is an illustration of a first alternative embodiment of a tubular hollow cruciform element 4 defining a median duct 5 and peripheral ducts 6 separated from each other by spaces 7.

In cross-section, the peripheral ducts 6 are substantially in the shape of the letter Ω so that the opening of the spaces 7 presents a width l notably smaller than the width L of said Ω-shaped ducts.

In this manner, the hollow elements of FIG. 3 have walls of great softness until the edges of the two Ω-shaped ducts come into engagement, thereby stiffening the element which is not completely crushed. Moreover, the opening of the spaces 7 results in that two elements cannot mutually interpenetrate, one being thereby ensured of a good drainage or of a good irrigation.

Figure 4:
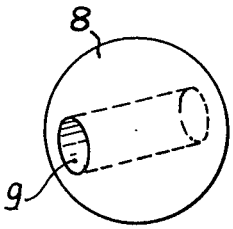

In FIG. 4, the hollow elements 8 are spherical-shaped, or approximately spherical-shaped bodies, through which are formed one or several ducts 9. Such hollow bodies of small dimension, their diameter being of a few millimeters, constitute small containers retaining water by capillarity in the ducts 9 while forming wedges between the other hollow elements.

Figure 5:
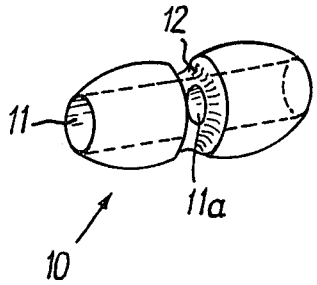

In FIG. 5, the hollow element, designated by numeral 10, is in the form of a diabolo with a longitudinal channel 11, a median groove 12 and a second transverse channel 11*a*; there again, the retention of water is provided by capillarity, within the channels 11 and 11*a* and eventually in the groove 12, while a mass of hollow elements having this shape cannot result into a compact block.

Figure 6:
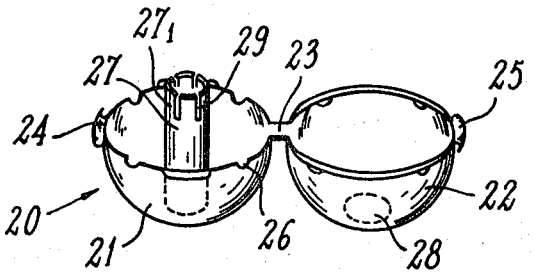

FIG. 6 illustrates a hollow element 20 made of plastics material, for example by moulding, comprising two half-spheres 21, 22, connected by a binding lug 23 acting as a hinge. The half-spheres 21, 22 comprise mutual interlocking means 24, 25 which lock them when they are placed side by side after folding the lug 23.

In the example shown, the interlocking means 24, 25 extend only over part of the periphery of the half-spheres 21, 22 and are respectively a female element and a male element. Said interlocking elements could also be formed by hooks extending over the whole periphery of the two half-spheres.

At least one of the two half-spheres, in the example shown the half-sphere 21, is formed with notches 26 such that, when the two half-spheres are assembled, they delimit communication holes.

Figure 7:
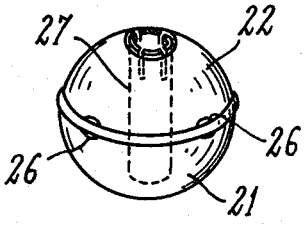
FIG. 7 is a perspective view of the same element, in a closed condition.
Figure 8:
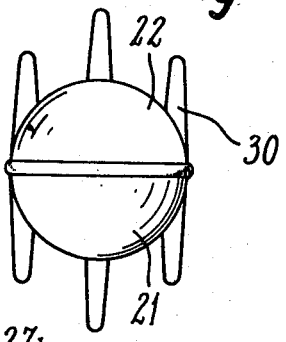
FIG. 8 is a perspective view of an alternative embodiment of the drainage and irrigation element.

One of the half-spheres, in the present case the half-sphere 21, comprises a tube 27 extending from its bottom. The length of tube 27 is at least equal to the diameter of the half-spheres and, preferably, larger, as said tube is adapted for passing through a hole 28 of the other half-sphere when the latter is doubled up as is shown in FIG. 7. The end $27_1$ of the tube 27 is advantageously formed with longitudinal cut-outs 29 which may make the introduction in the hole 28 easier and provide a capillar communication between the inside of tube 27 which is hollow and the inside of the sphere.

In some cases, it is advantageous that the spherical elements have a different diameter or that the tubes 27 are more or less protruding, thereby providing a heterogeneous distribution of the elements in the ground in which they are buried.

The spherical hollow elements serve for the retention or the drainage of a certain quantity of water since their inside is hollow and, on the other hand, water may flow through the tube 27 or be retained in it. In the case of the irrigation of a soil and once it has been watered, the spheres are filled as well as the tubes and the water is then redistributed to the ground, but progressively. As a matter of fact, the water can flow first more easily from the inside of the tube, and then, it is the water contained in the spheres which is progressively distributed by passing through the notches 26 and/or eventually the slots 29 and the inside of the tube.

On the other hand, the volumes of earth which separate the various buried spheres have irregular shapes resulting in that the water is also more easily retained in the earth even when the latter contains the spherical elements hereabove described.

The water retention spherical elements are also efficient for the drainage. When they are buried in a ground which is saturated with water, the water has in fact a tendency to fill up the spheres, which favours afterwards the drying of the earth volumes separating said spheres since the earth volumes are no more saturated with water when the spheres are full, and the water contained in the spheres is then progressively returned to the ground as its drying proceeds. On the other hand, if the density of the spheres is large in a ground, the flow of water is favoured due to the presence of the tubes 27 forming successive drains.

Figure 9:
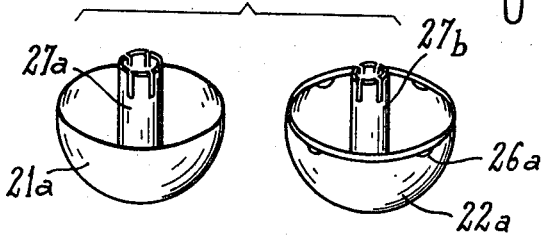
FIG. 9 is an elevation view showing a further development of the invention.

The drainage and irrigation elements in the shape of spheres may be realized in other ways than those just described; for example, and as is shown in FIG. 9, it is possible to mould two half-spheres **21*a*, 22*a*, one of which at least being formed with notches 26*a*** on its edge.

According to FIG. 9, each half-sphere comprises a tube segment **27*a*, 27*b*, said segments being adapted for being interlocked into each other. In this way, one may omit the mutual interlocking means 24, 25** described above.

The word "sphere" has been used hereabove since it describes well the general outer aspect of the drainage and irrigation element. However, if it is desired, one may use elements formed with facets and/or outer protrusions resulting in that two drainage and irrigation elements cannot be joined side by side. This is what is represented in FIG. 9 which shows protrusions 30 formed at various points of the half-spheres 21, 22, said protrusions being advantageously hollow for contributing themselves to the retention of water.

The hollow elements described hereabove, whatever their shape, are made of plastics material, synthetic or not, and preferably biodegradabe, for example paper, cardboard or any other vegetable material, for example peat. The material used for the formation of the elements is also bonded, if need be, by biodegradable product means, for example vegetable or animal glues. For making the tubes, it is also possible to use mineral materials, for example sand bound by biodegradable glues.

Figure 10:
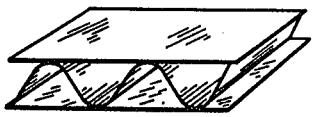
FIG. 10 is a perspective view of a particular hollow element.

Another way of making the elements consists, as is shown in FIG. 10, in using corrugated cardboards, eventually salvaged, and in cutting them so that they define hollow elements of variable extension.

A development consists in the impregnation of the materials used for the formation of the elements with various fertilizing products, and particularly fertilizers.

The composition of the elements may vary as a function not only of the nature of the grounds in which the elements have to be buried, but also of the nature of the plantings which are to be made or of the plants already planted. In view of the biodegradable nature of the material forming the elements, or at least the binding material, which provides the cohesiveness of the mineral minerals used and which are close to the nature of a natural soil, it appears that the mass of the tubular elements which is buried in the ground destroys itself progressively and the result is a progressive lightening of the ground and the fertilization of the latter when fertilizers are added as supplement.

FIGS. 11 to 14 illustrate a further development according which the hollow elements may be indifferently made of a biodegradable material or not.

Figure 11:
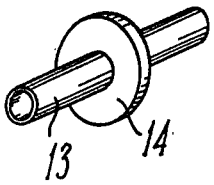
FIGS. 11 to 14 are perspective views of alternative embodiments of a further development of the invention.

According to FIG. 11, a hollow tubular element 13, cylindrical or of any other shape, is provided with a flange 14.

Figure 12:
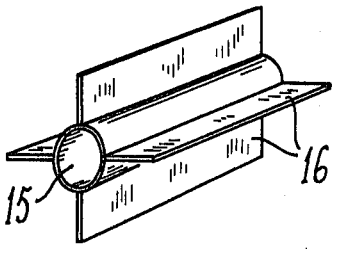

According to FIG. 12, the hollow tubular element 15 is formed with rectilinear or curved wings 16.

Figure 13:
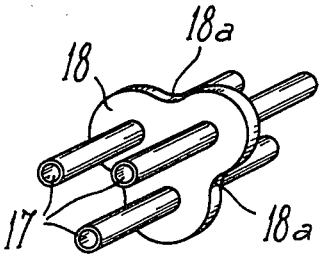

According to FIG. 13, several hollow tubular elements 17 are assembled, at a distance from each other, by a flange 18 which, preferably, is not circular-shaped but defines indentations **18*a*** resulting in the formation of baffles even when several elements are joined together.

Figure 14:
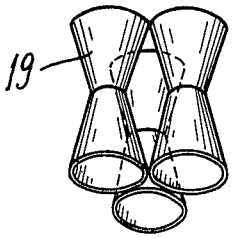

According to FIG. 14, the element comprises several tubes 19, for example three in number, assembled to each other and having each the shape of a diabolo.

It is apparent that all the hereabove described dispositions have means preventing the hollow elements to be directly joined side by side so that they form a foaming mass of low density which particularly improves the draining or irrigation qualities of the ground in which the hollow elements are buried.

It is often advantageous to us hollow elements of various nature, notably hollow elements the biodegradable binding material of which has a variable life-time.

It has been found as particularly advantageous, for forming the draining or irrigation mass, to mix the various elements described hereabove so that their respective qualities add up and make the mass porous and soft. Although this is not shown, it is also possible to mix sand, and even earth, to the mass of hollow elements.

The invention is not limited to the embodiments shown and described in detail, and various modifications may be carried out without departing from its scope.

What is claimed is:

1. A mass for draining, irrigating or lightening of various soils, said mass being composed of hollow elements of various sizes, shapes, wall thicknesses and rigidity, said hollow elements internally defining through open-ended capillary or semi-capillary passages, said mass further being composed of soil in which said hollow elements are dispersed in mutual contact and so oriented relative to one another as to provide between adjacent hollow elements spaces of various shapes and dimensions which combine with the capillary or semi-capillary passages of the hollow elements to form a porous mass for drainage, irrigation or lightening of the soil, the hollow elements including elements that comprise two hollow hemispheres and means for joining said hollow hemispheres to form hollow spheres.

2. A mass according to claim 1 wherein said joining means includes tubes protruding from each hollow hemisphere and interlockable with one another.

3. A mass according to claim 2 wherein at least some of the hollow elements include internal protrusions and wherein the protrusions are hollow and internally communicate with the insides of the hollow elements.

* * * * *

UNITED STATES PATENT AND TRADEMARK OFFICE

CERTIFICATE OF CORRECTION

PATENT NO. : 4,411,555

DATED : October 25, 1983

INVENTOR(S) : Monique Lucie Suzanne Minvielle; Albert Henri Felix Mazoin; Robert Pierre Brun; Sylvain Victor Louis Cheyanne; Jacques Leon Alexandre See It is certified that error appears in the above-identified patent and that said Letters Patent are hereby corrected as shown below:

Item Number 22 of the cover page:

"June 17, 1980" should read --July 17, 1980--.

Signed and Sealed this

*Twenty-first* Day of *August 1984*

[SEAL]

*Attest:*

GERALD J. MOSSINGHOFF

*Attesting Officer*

*Commissioner of Patents and Trademarks*